US005538437A

United States Patent [19]

Bates, III et al.

[11] Patent Number: 5,538,437

[45] Date of Patent: Jul. 23, 1996

[54] CONNECTOR ASSEMBLY FOR IC CARD

[75] Inventors: Charles L. Bates, III, Laguna Hills; Gary C. Bethurum, Laguna Niguel, both of Calif.

[73] Assignee: ITT Industries, Inc., New York, N.Y.

[21] Appl. No.: 398,026

[22] Filed: Mar. 3, 1995

[51] Int. Cl.[6] ..... H01R 13/627

[52] U.S. Cl. ..... 439/352; 439/286

[58] Field of Search ..... 439/352, 286, 439/288, 294, 357, 59

[56] References Cited

U.S. PATENT DOCUMENTS

| | | | |
|---|---|---|---|
| 2,654,872 | 10/1953 | Saul . | |
| 3,501,735 | 3/1970 | Ballman . | |
| 3,587,037 | 6/1971 | Anhalt . | |
| 3,646,501 | 2/1972 | Valtonen . | |
| 3,848,222 | 11/1974 | Lightner . | |
| 3,977,749 | 8/1976 | Langenbach . | |
| 4,083,619 | 4/1978 | McCormick . | |
| 4,265,503 | 5/1981 | Baur . | |
| 4,362,348 | 12/1982 | Stephenson . | |
| 4,504,101 | 3/1985 | Reimer . | |
| 4,505,527 | 3/1985 | Reimer . | |
| 4,591,217 | 5/1986 | Reimer . | |
| 4,591,219 | 5/1986 | Reimer . | |
| 4,591,619 | 7/1986 | Reimer . | |
| 4,597,620 | 7/1986 | Lindner . | |
| 4,695,111 | 9/1987 | Grabbe . | |
| 4,810,206 | 3/1989 | Rosenfeld . | |
| 4,838,808 | 6/1989 | Fujiura | 439/352 |
| 5,368,496 | 11/1994 | Ranalletta . | |
| 5,387,110 | 2/1995 | Kantner et al. | 439/352 |
| 5,411,402 | 5/1995 | Bethurum | 439/352 |

*Primary Examiner*—David L. Pirlot
*Assistant Examiner*—Yong K. Kim
*Attorney, Agent, or Firm*—Thomas L. Peterson

[57] ABSTRACT

A connector assembly is disclosed having a latching mechanism for locking the assembly to the rear of an IC (integrated circuit) card. The assembly incorporates an actuator for operating the latching mechanism. The actuator is rotatably mounted at the rear portion of the housing of the connector assembly, which allows the assembly to have a short profile. The cable for the assembly is connected to one side of the housing.

18 Claims, 5 Drawing Sheets

FIG. 1
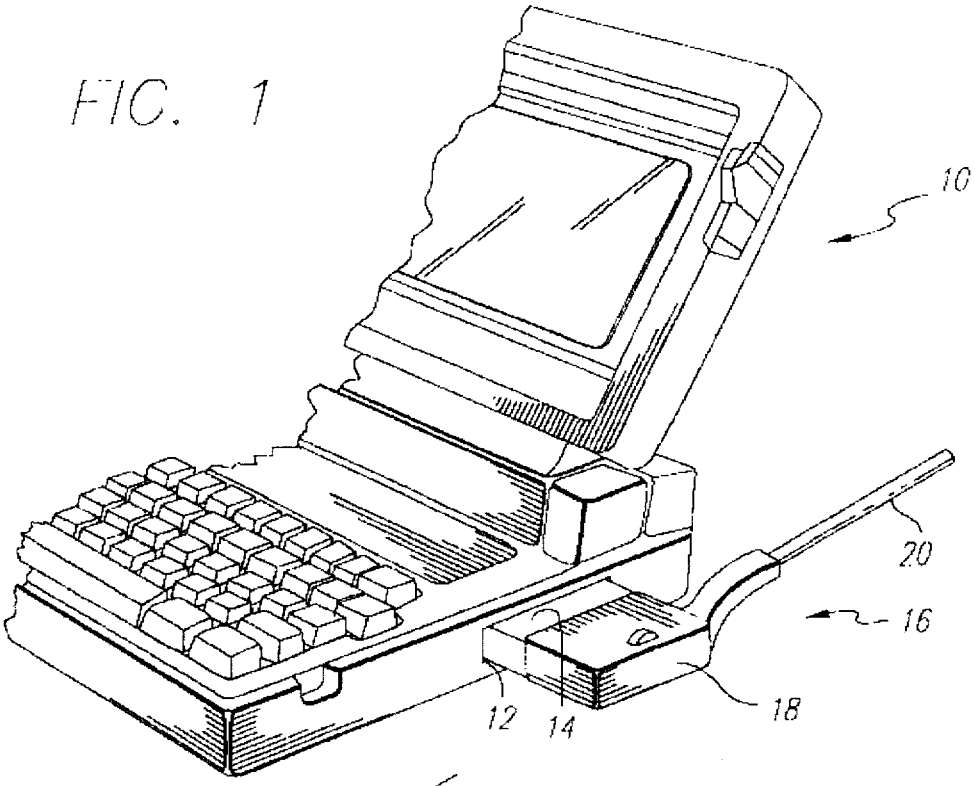
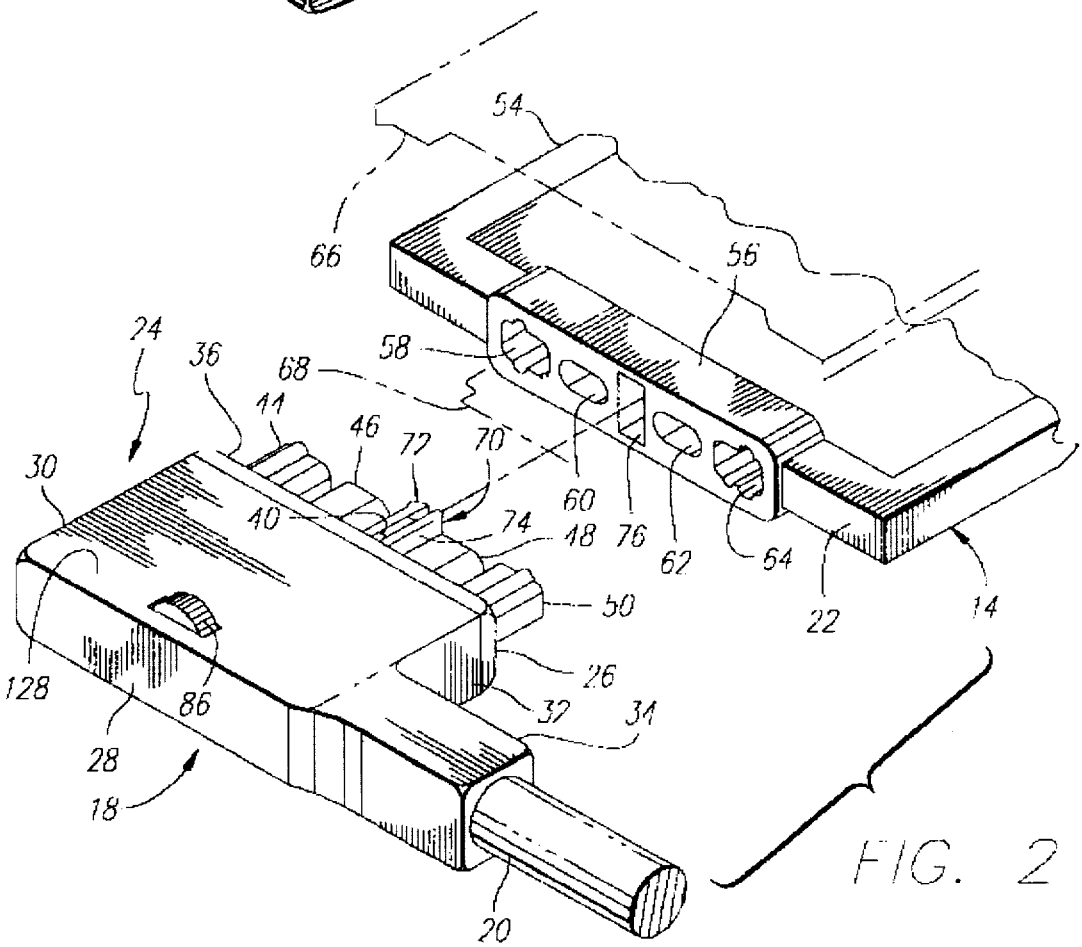
FIG. 2

FIG. 3
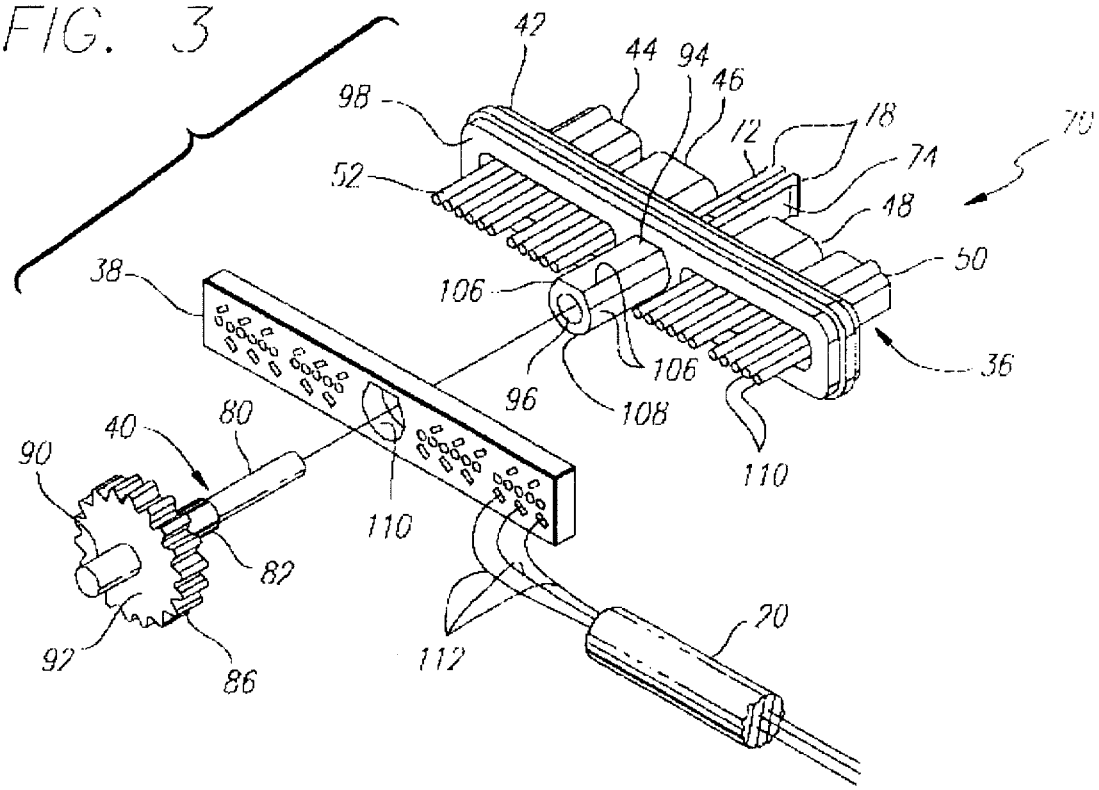
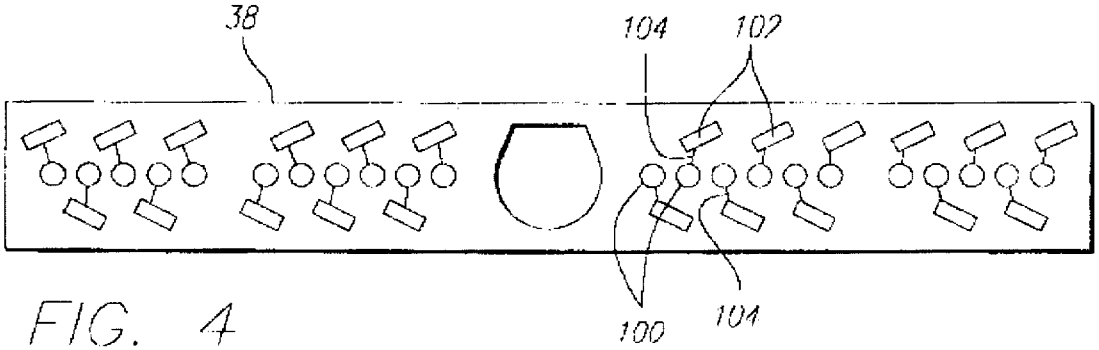
FIG. 4
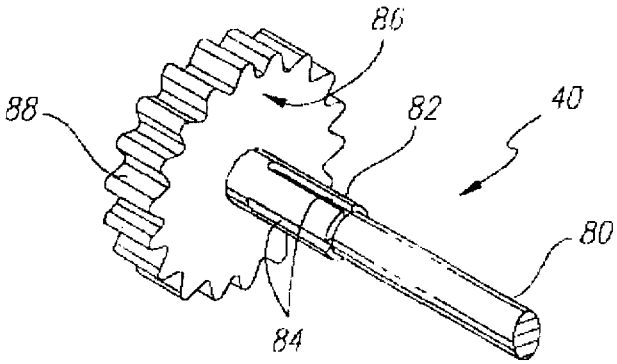
FIG. 5

FIG. 6
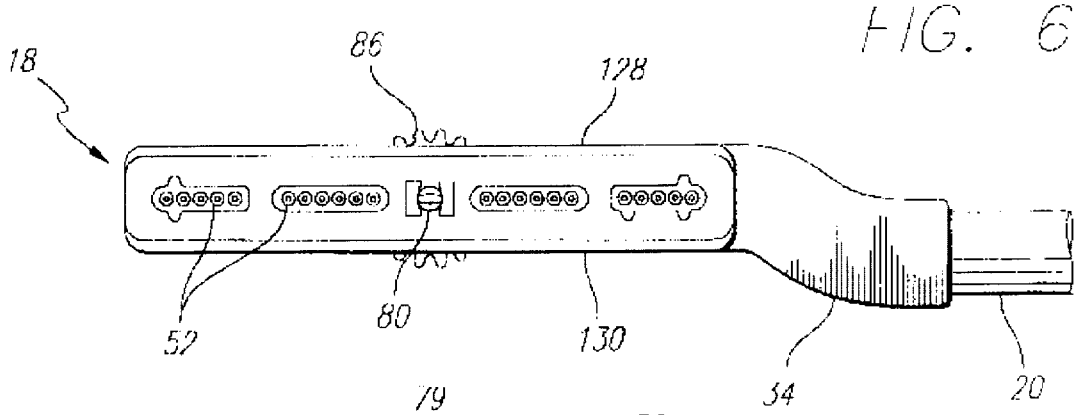
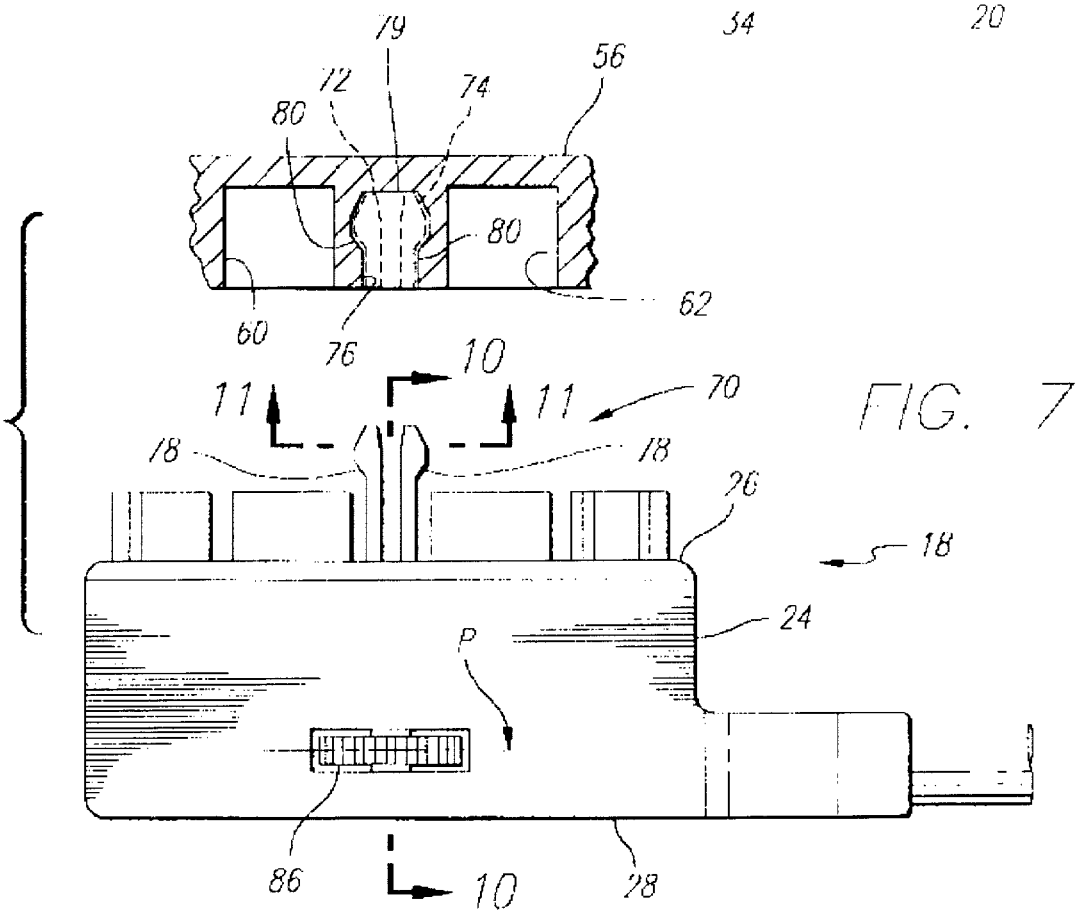
FIG. 7
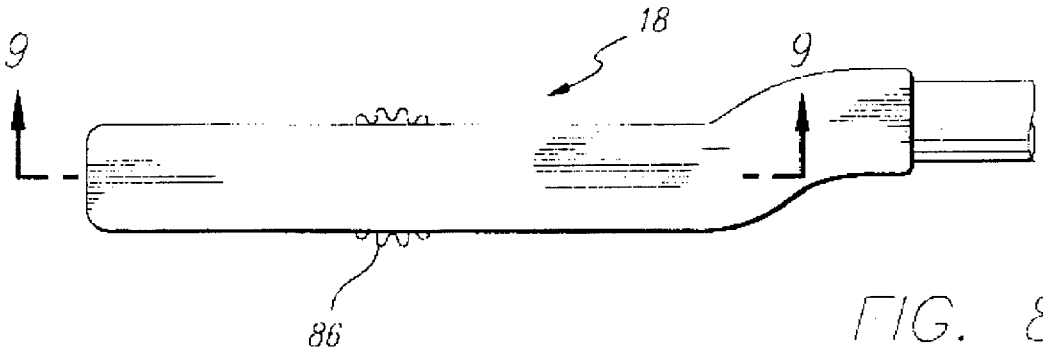
FIG. 8

CONNECTOR ASSEMBLY FOR IC CARD

BACKGROUND OF THE INVENTION

The present invention relates generally to an electrical connector assembly and, more particularly, to such an assembly that is connected to an input/output connector mounted at the rear end of an IC (integrated circuit) card.

Copending U.S. patent application, Ser. No. 08/169,682, filed Dec. 17, 1993, entitled "Connector Assembly for IC Card," assigned to the assignee of the present application, discloses a connector assembly which is connectable to an input/output connector of an IC card. The card may be a PCMCIA card of the type that is mounted in a port in the side of a lap-top computer. In such connector assembly, a latching mechanism is provided, including a pair of spaced latch arms extending forwardly from the assembly, with a slidable rod that, when moved to a forward position between the latch arms, prevents the arms from being disconnected from the input/output connector of the IC card. When the rod is retracted to a rear position in the connector assembly, the latch arms are allowed to collapse, thereby permitting the connector assembly to be disconnected from the IC card.

The latching mechanism of such prior connector assembly relies on the travel distance of the rod to lock and unlock the assembly to the corresponding input/output connector of the IC card. As a result, the overall profile, or length, of the connector assembly is dictated by the length of the rod, and the distance required to slide the rod between its locked and unlocked position. As a consequence, the length or profile of the connector assembly is somewhat greater than is desired by some users.

It is an object of the present invention to provide a connector assembly for coupling to an IC card, which allows the assembly to have a relatively short profile.

It is another object of the invention to provide a connector assembly having fewer parts than exists in the connector assembly disclosed in the aforementioned pending patent application.

SUMMARY OF THE INVENTION

According to a principal aspect of the present invention, there is provided an electrical connector assembly of the general type described above, except that the latching mechanism of the assembly includes a rotatable cam shaft having its forward end located between the latching arms of the assembly. An actuator, preferably in the form of a rotatable knob, is fixed to the rear of the cam shaft to rotate the shaft. The cam shaft is rotatable from one position, wherein the cam shaft is located to prevent release of the connector assembly from the input/output connector of the IC card to which it is connected, to a second position which allows the latching arms to deflect inwardly so that the latching mechanism may be released to permit disconnection of the connector assembly from the input/output connector of the IC card. Since the actuator is movable in a plane transverse to the direction of the latch arms, the length of the connector assembly may be shortened to provide a short profile assembly.

According to another aspect of the present invention, the cable that is connected to the housing of the connector assembly enters the housing at one side thereof, which not only allows a short profile, but also permits the cable to run rearwardly from the side of the lap-top computer with which the assembly is used. This arrangement is more convenient for the user than having the cable extend laterally outwardly from the side of the computer where the cable can become entangled with other cables or objects.

The invention will be best understood from the following description when read in conjunction with the accompanying drawings.

BRIEF DESCRIPTION OF THE DRAWINGS

FIG. 1 is an isometric view of a lap-top computer having an IC card mounted therein, with the connector assembly of the inventions/connected to the card.

FIG. 2 is an exploded isometric view of the connector assembly and the rear portion of an IC card with which the connector assembly mates.

FIG. 3 is an exploded isometric view showing components of the connector assembly shown in FIG. 2, with a cable having conductors connected to a printed circuit board used in the assembly.

FIG. 4 is a plan view of the printed circuit board shown in FIG. 3.

FIG. 5 is an enlarged, isometric view of the cam shaft and actuator used in the connector assembly.

FIG. 6 is a front elevation view of the connector assembly of FIG. 2.

FIG. 7 is a bottom view of the connector assembly of FIG. 2, including a sectional view of a portion of the input/output connector used in the IC card.

FIG. 8 is a rear elevation view of the connector assembly of FIG. 2.

DESCRIPTION OF THE PREFERRED EMBODIMENT

Figure 9:
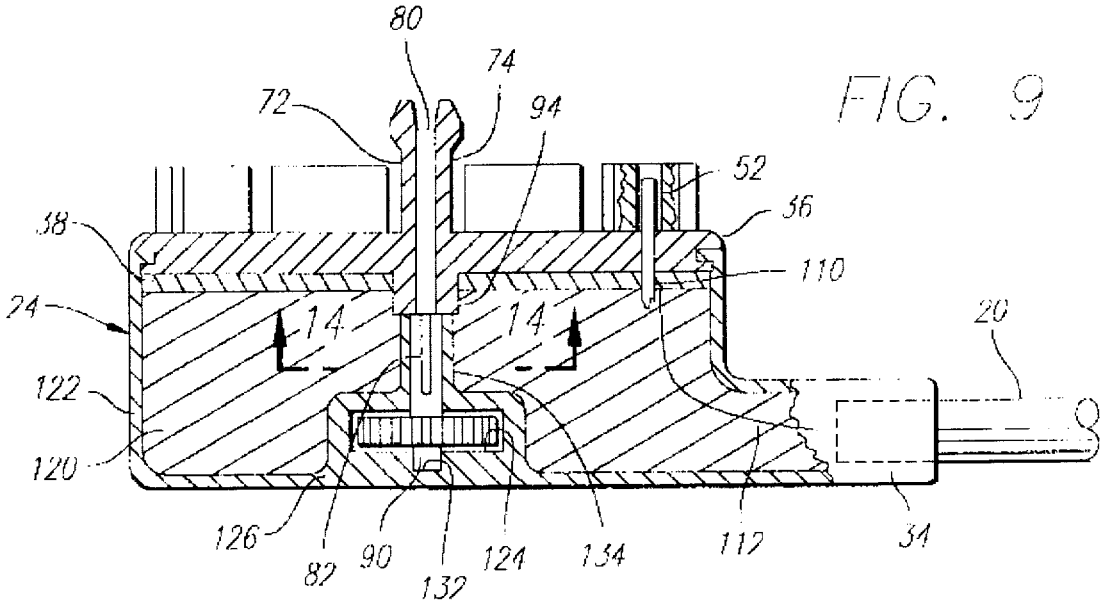
FIG. 9 is a partial, horizontal sectional view taken along line 9—9 FIG. 8.

Referring now to the drawings in detail, there is shown in FIG. 1 a lap-top computer 10 having a port 12 opening at its side, in which an IC card 14 is mounted. A cable assembly, generally designated 16, comprises the connector assembly 18 of the present invention, and a cable 20. The connector assembly is shown connected to the exposed end of the IC card 12.

FIG. 2 shows the connector assembly 18 positioned to mate with the rear portion 22 of the IC card 14. The connector assembly comprises an insulative housing 24 having a forward end 26, a rear end 28, and opposite sides 30 and 32. An extension 34 is formed on the side 32 through which the cable 20 enters the housing 24.

As best seen in FIG. 3, the connector assembly includes a plug header 36, a printed circuit board 38, and a cam shaft 40. The header 36 comprises an insulative body 42 formed with four plug parts 44, 46, 48, and 50. A row of pin contacts 52 are mounted in the connector body 42. The mating ends of the contacts extend into the respective plug parts 44–50.

As seen in FIG. 2, the IC card 14 includes an insulative rectangular frame 54 having a receptacle connector 56 located at the rear portion 22 of the frame. The receptacle connector 56 is formed with recesses 58, 60, 62, and 64 that slidably receive the plug parts 44–50 of the connector assembly 18 when the assembly is connected to the receptacle connector at the rear of the IC card. Socket contacts (not shown) mounted in the connector 56 extend into the recesses 58–64. The socket contacts engage the pin contacts 52 when the connector assembly 18 is mated with the receptacle connector 56. Metal covers 66 and 68, shown in phantom lines in FIG. 2, are mounted on opposite sides of the frame 54 to enclose a printed circuit board (not shown) mounted within the card.

The connector assembly 18 includes a latching mechanism, generally designated 70, for latching and locking the plug header 36 of the connector assembly to the receptacle connector 56 of the IC card. The latching assembly includes two resilient latch arms 72 and 74 that extend forwardly from the body 42 of the plug header between the two plug parts 46 and 48. Preferably, the latch arms are integrally formed with the body 42 to reduce the number of parts required to form the assembly. The latch arms are designed to be received in a central recess 76 in the receptacle connector 56 of the IC card. The latch arms are deflected together as they are pushed into the recess 76. Outwardly extending projections 78 are formed at the forward ends of the arms. When the projections reach an enlarged cavity 79 at the rear of the recess 76, the arms spring outwardly to their normal position, whereupon the projections 78 on the arms engage rearwardly-facing shoulders 80 formed at the rear of the walls of the central recess 76. In FIG. 7, the forward ends of the latch arms 72 and 74 are shown in phantom, in a latched position within the recess 76. The arms resist rearward movement of the connector assembly 18 but, by themselves, do not lock the connector assembly to the IC card.

The latching mechanism 70 also includes the cam shaft 40. As best seen in FIGS. 3 and 5, the cam shaft 40 includes a forward cam portion 80 and a rear detent portion 82. The forward cam portion 80 has an elliptical-shaped cross-section. Four longitudinally extending detent ribs 84 are formed on the rear portion 82 of the cam shaft. The ribs are offset from each other by an angle of 90°. Two of the ribs are aligned with the major axis of the elliptical-shaped cam portion 80 of the shaft 40, while the other two ribs are aligned with the minor axis of the elliptical-shaped cam portion. An actuator 86 is integrally formed on the cam shaft 40 spaced behind the detent ribs 84. Preferably, the actuator is in the form of a circular knob or disc that has serrations 88 on its outer surface to facilitate manual operation of the actuator. The cam shaft 40 includes a short rear stub portion 90 that extends rearwardly from the rear face 92 of the actuator. Preferably, the cam shaft 40 with the actuator 86 thereon is a one-piece molded part.

A boss 94 extends rearwardly from the central part of the body 42 of the plug header 36. The boss has a central bore 96 which rotatably receives the forward cam portion 80 of the cam shaft.

The printed circuit board 38 is mounted vertically in the connector housing 24, flush with the rear face 98 of the body 42 of the plug header. The printed circuit board is provided with a row of plated-through holes 100 that are aligned with the contacts 52 in the plug header. The plated-through holes are electrically connected to conductive pads 102 on the board by traces 104.

The boss 94 on the rear of the plug header 36 has three flat upwardly-facing surfaces 106, and a semi-cylindrical lower surface 108. The printed circuit board 38 is formed with a central aperture 110 having a configuration complementary to the outer surface of the boss 94 so as to slidably receive the boss in only one position of the printed circuit board when the board is mounted flush against the rear face of the plug header. In such position, the tails 110 at the rear of the contacts 52 in the plug header extend a short distance through the plated-through holes in the printed circuit board, as seen in FIG. 9. Preferably the tails have a press-fit connection with the plating in the holes. Solder may also be added to the rear ends of the tails to enhance the electrical connection.

As seen in FIG. 3, the conductors 112 (only three being shown for purposes of simplicity) of the cable 20 are soldered at their ends to respective conductive pads 102 on the printed circuit board. Thus, it will be appreciated that the contacts 52 in the plug header 36 are electrically connected to the conductors 112 of the cable via the plated-through holes 100, conductive traces 104, and the conductive pads 102 on the printed circuit board.

As seen in FIG. 9, the housing 24 of the connector assembly 18 includes a pre-mold section 120 and an over-mold section 122. The pre-mold section may be formed of a slightly resilient thermoplastic material, while the over-mold section is preferably formed of a more flexible type thermoplastic material, which allows the extension 34 of the housing to function as a strain relief for the cable. A vertical slot 124 is formed in a central portion 126 of the over-mold section 122 of the connector housing. The slot opens at the upper surface 128 and lower surface 130 of the housing. The cam shaft 40 is mounted in the connector housing with the actuator 86 positioned in the slot 124. The diameter of the actuator 86 is such that the periphery of the actuator extends outwardly beyond the upper surface 128 and lower surface 130 of the housing a short distance, sufficient to allow the user to rotate the actuator with his fingers.

Figure 14:
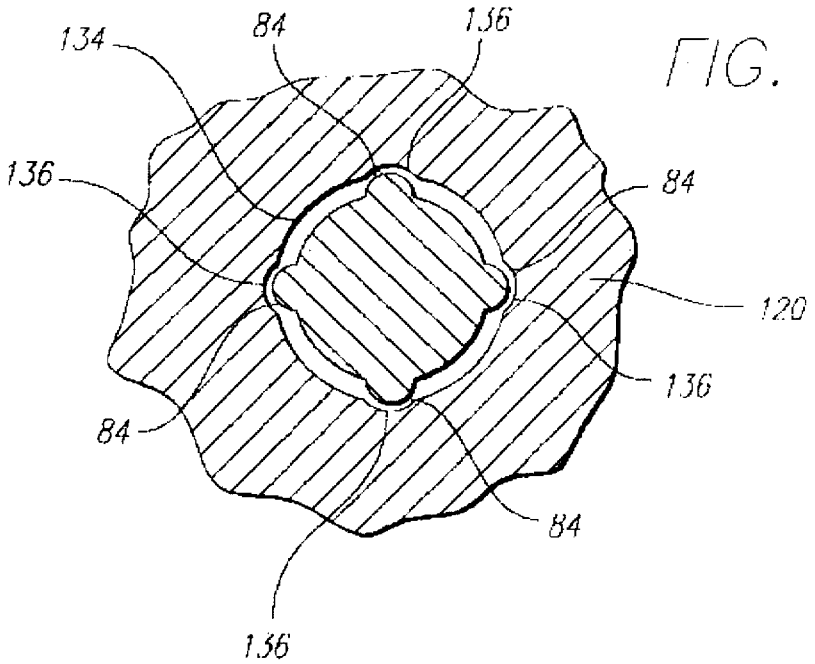
FIG. 14 is a vertical sectional view taken along line 14—14 of FIG. 9.

The rear stub portion 90 of the cam shaft is rotatable in a bore 132 that opens into the slot 124 in the over-mold section 122. As best seen in FIG. 14, that portion of the rear detent portion 82 of the cam shaft formed with the detent ribs 84 is located in a bore 134 formed in the pre-mold section 120 of the connector housing. Four grooves 136 are formed in the wall of the bore 134 displaced 90° with respect to each other. The grooves are shaped to receive the detent ribs 84 on the cam shaft. When the cam shaft is rotated 90° in either direction, the shaft will be releasably retained and positioned by the engagement of the detent ribs 84 with the grooves 136. The resiliency of the pre-mold section 120 allows the ribs to shift from one groove to the next when the cam shaft is rotated.

Figure 10:
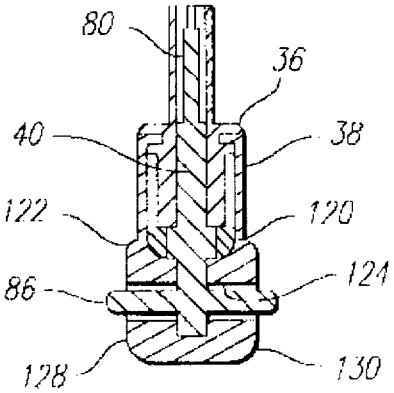
FIG. 10 is a vertical sectional view taken along line 10—10 of FIG. 7 showing the cam shaft of the invention in its locked position.
Figure 11:
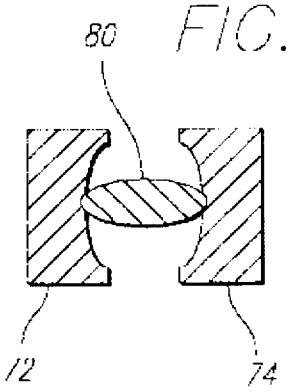
FIG. 11 is a transverse sectional view taken along line 11—11 of FIG. 7, showing the cam shaft of the invention in its locked position.
Figure 12:
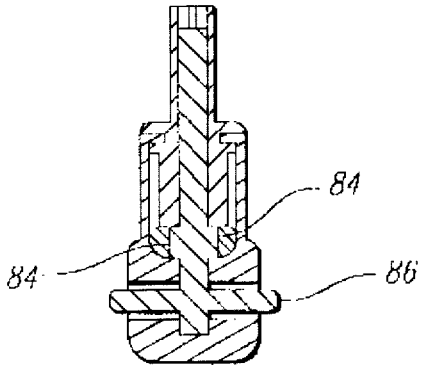
FIGS. 12 and 13 are sectional views similar to FIGS. 10 and 11, but showing the cam shaft in its unlocked position.
Figure 13:
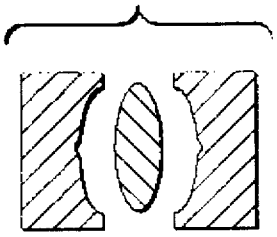

Reference is now made to FIGS. 10 and 11 of the drawings, which show the cam shaft in a locked position, wherein the forward elliptical-shaped cam portion 80 of the shaft is positioned with its major axis lying in a horizontal plane, thereby blocking the latch arms 72 and 74 of the latching mechanism from being deflected toward each other. In this condition, the connector assembly 18 cannot be disconnected from the receptacle connector 56 of the IC card. When it is desired to disconnect the connector assembly 18 from the card, the cam shaft 40 is rotated 90° from the position shown in FIGS. 10 and 11, to the position shown in FIGS. 12 and 13. The elliptical-shaped forward cam portion 18 of the cam shaft is then positioned with its major axis extending in a vertical plane, thereby providing a space between the cam shaft and the latch arms. In this condition of the latching mechanism, when a rearward force is applied by the user to the connector assembly 18, the latch arms 72 and 74 of the latching mechanism will be deflected toward each other so that the connector assembly can be disconnected from the receptacle connector of the IC card.

Since the cam shaft 40 of the latching mechanism 70 of the present invention is operated by rotating the shaft via the actuator 86, which moves in a plane transverse to the direction of the latch arms 72 as seen in FIG. 7, the connector assembly of the invention may have a relatively short profile.

The short profile of the connector is enhanced by the fact that the actuator 86 for the cam shaft extends rearwardly no further than the rear end 28 of the connector housing 24, and the printed circuit board 38 is mounted vertically within the housing 24.

Figure 15:
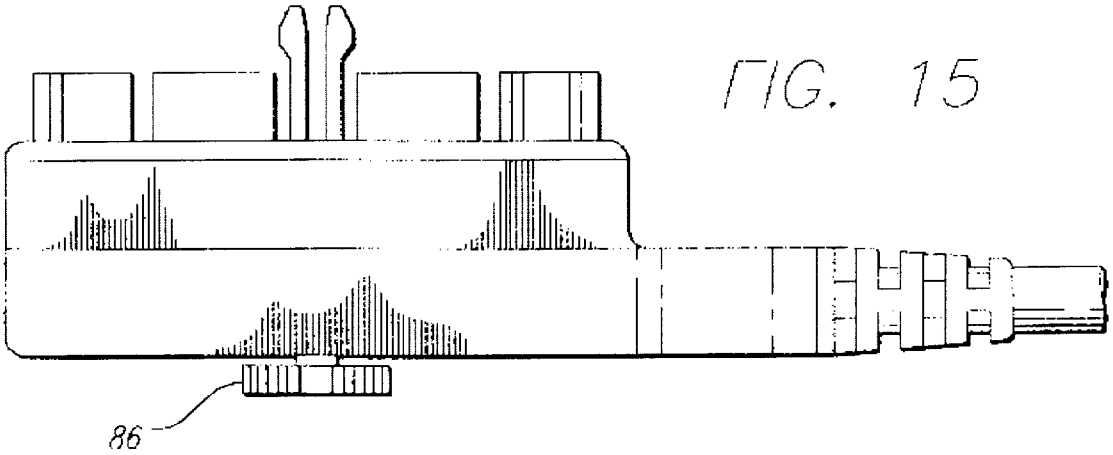
FIG. 15 is a bottom view of an alternative embodiment of the connector assembly of the invention.
Figure 16:
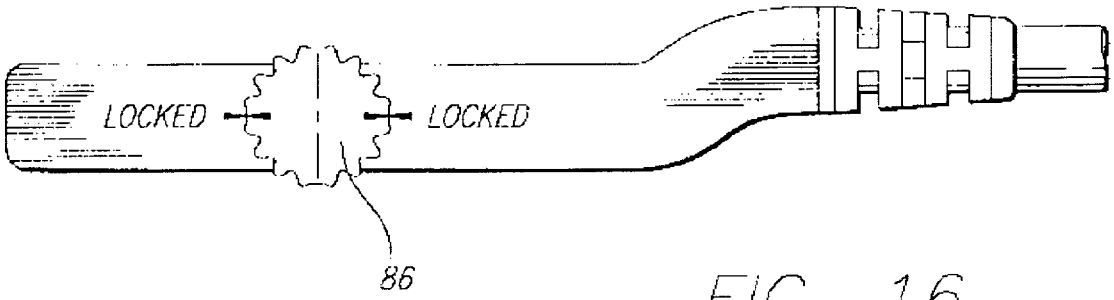
FIG. 16 is a rear elevation view of the connector assembly illustrated in FIG. 15.

An alternative embodiment of the invention is shown in FIGS. 15 and 16. In such embodiment, the actuator 86 is disposed behind the rear end 28 of the connector housing. This arrangement results in some sacrifice in the length of the connector assembly in the longitudinal extent of the assembly.

While in the connector assembly described herein the rotatable cam shaft is shown to be operated by an integral actuator 86, it will be appreciated that the cam shaft could also be oscillated over a 90° angle by a push button slidable on the connector housing parallel to the plane P shown in FIG. 7, with a suitable pin and slot interconnection arrangement between the shaft and the push button (not shown).

As can be appreciated from the foregoing description, the connector assembly of the present invention has the advantage that it has a relatively short profile, and requires only a minimum number of parts. Further, since the cable 20 is connected at the side of the housing of the connector assembly, rather than at the rear, the cable will extend in a rearward direction out of the way of the user when the connector assembly is coupled to an IC card mounted in the side of a computer, as seen in FIG. 1.

While terms such as "upper", "lower", "vertical"and "horizontal", etc., have been used herein to aid in the description of the invention, the connector assembly may be used in any orientation with respect to gravity.

Although particular embodiments of the invention have been described and illustrated herein, it is recognized that modifications and variations to the invention may readily occur to those skilled in the art and, consequently, it is intended that the claims be interpreted to cover such modifications and equivalents.

We claim:

1. A connector assembly comprising:

an insulative housing having a forward end, a rear end, and opposite sides extending from said forward end and said rear end;

a plurality of contacts located at said forward end of said housing, said contacts being adapted to be electrically connected to the conductors of an electrical cable;

a latching mechanism on said housing for latching said housing to a mating connector;

said latching mechanism including at least one latch arm extending forwardly from said forward end of said housing; and an actuator located between said sides of said housing, said actuator being operatively associated with said latch arm to permit said latch arm to be selectively locked to and releasable from said mating connector, said actuator being movable in a plane transverse to the direction of said latch arm.

2. A connector assembly as set forth in claim 1 in combination with an electrical cable having conductors electrically connected to said contacts, and said cable is connected to said housing at one of said sides thereof.

3. A connector assembly as set forth in claim 2 wherein:

the length of said housing between said forward and rear ends thereof is less than the width of said housing between said opposite sides.

4. A connector assembly as set forth in claim 1 wherein there is provided two of latch arms; and said latching means includes a rotatable cam shaft positioned between said latch arms, and having a rear end connected to said actuator.

5. A connector assembly as set forth in claim 1 wherein:

said actuator is a rotatable disc.

6. A connector assembly as set forth in claim 5 wherein:

said disc is positioned in said housing in front of said rear end thereof;

said housing has upper and lower surfaces; and said disc extends through an aperture opening at at least one of said surfaces.

7. A connector assembly as set forth in claim 1 wherein:

said actuator is located outside said rear end of said housing.

8. A connector assembly as set forth in claim 1 wherein:

said actuator extends rearwardly no further than said rear end of said housing.

9. A connector assembly as set forth in claim 1, including:

a printed circuit board mounted vertically within said housing; and said printed circuit board has conductors thereon for providing electrical connection between said contacts and the cable conductors.

10. A connector assembly comprising:

an insulative housing having a forward end, a rear end, and opposite sides extending from said forward end to said rear end;

a plurality of contacts located at said forward end of said housing;

a cable connected to said housing, said cable having conductors electrically connected to said contacts;

a latching mechanism on said housing for latching said housing to a mating connector;

said latching mechanism including a pair of resilient latch arms extending forwardly from said forward end of said housing, and a cam shaft lying between said latch arms;

said cam shaft being rotatable between first and second positions, in said first positions said cam shaft preventing said latch arms from deflecting toward each other, and in said second position said latch arms being free to deflect toward each other; and an actuator on said housing for rotating said cam shaft between said first and second positions.

11. A connector assembly as set forth in claim 10 wherein:

said actuator is located between said sides of said housing.

12. A connector assembly as set forth in claim 10 wherein:

said cam shaft has a rear end extending through said rear of said housing; and said actuator is fixed to said rear end of said cam shaft.

13. A connector assembly as set forth in claim 11 wherein:

said cable is connected to said housing at one of said sides thereof.

14. A connector assembly as set forth in claim 10 wherein:

said latch arms have front portions forming outwardly extending projections.

15. A connector assembly as set forth in claim 10, including:

detent means on said cam shaft and said housing for releasably retaining said cam shaft in said first and second positions.

16. A connector assembly as set forth in claim 10, including:

a printed circuit board mounted vertically within said housing; and said printed circuit board has conductors thereon providing the electrical connection between said contacts and said cable conductors.

17. A connector assembly as set forth in claim 10 wherein:

said housing comprises a forwardly positioned connector body containing said contacts, and a rear molded portion; and said actuator is integral with said cam shaft and said latch arms are integral with said connector body.

18. A connector assembly comprising:

an insulative housing having a forward end, a rear end, and opposite sides extending from said forward end to said rear end;

the length of said housing between said forward and rear ends thereof being less than the width of said housing between said opposite sides;

a plurality of contacts located at said forward end of said housing;

a cable connected to one of said sides of said housing, said cable having conductors electrically connected to said contacts;

a latching mechanism on said housing for latching said housing to a mating connector;

said latching mechanism including a pair of resilient latch arms extending forwardly from said forward end of said housing, and a cam shaft lying between said latch arms;

said cam shaft being rotatable between first and second positions, in said first positions said cam shaft preventing said latch arms from deflecting toward each other, and in said second position said latch arms being free to deflect toward each other; and an actuator on said housing for rotating cam shaft between said first and second positions.

* * * * *